US007473167B2

(12) United States Patent
Marmosh

(10) Patent No.: US 7,473,167 B2
(45) Date of Patent: Jan. 6, 2009

(54) SECURITY MODULE FOR USE WITH VENTILATION GRATING

(75) Inventor: Yousef S. Marmosh, Sacramento, CA (US)

(73) Assignee: Met California Group LLC, Sacramento, CA (US)

( * ) Notice: Subject to any disclaimer, the term of this patent is extended or adjusted under 35 U.S.C. 154(b) by 0 days.

(21) Appl. No.: 11/460,708

(22) Filed: Jul. 28, 2006

(65) Prior Publication Data

US 2008/0026686 A1 Jan. 31, 2008

(51) Int. Cl.
*F24F 13/06* (2006.01)
*F24F 13/068* (2006.01)
*E06B 9/01* (2006.01)

(52) U.S. Cl. ..... 454/270; 454/48; 454/271; 49/50

(58) Field of Classification Search ..... 454/48, 454/243, 245, 270, 271, 281, 306; 109/1 V; 49/50

See application file for complete search history.

(56) References Cited

U.S. PATENT DOCUMENTS 3,195,262 A * 7/1965 Metzler ..... 43/43.12
4,505,189 A * 3/1985 Morris et al. ..... 454/306
4,512,241 A * 4/1985 Morris et al. ..... 454/245
4,911,021 A * 3/1990 Shortridge ..... 73/861.66
5,099,686 A * 3/1992 Kohler ..... 73/182
5,205,784 A * 4/1993 DeHart et al. ..... 454/245
5,312,295 A * 5/1994 Young ..... 454/48
5,375,373 A * 12/1994 Tiede ..... 49/50
5,423,209 A * 6/1995 Nakaya et al. ..... 73/182
5,780,761 A * 7/1998 Musante et al. ..... 89/36.08
6,371,846 B1 * 4/2002 Powell et al. ..... 454/271
6,405,630 B1 * 6/2002 Gonzalez ..... 89/36.02
6,574,932 B2 * 6/2003 Layne et al. ..... 52/302.4

* cited by examiner

*Primary Examiner*—Steven B McAllister
*Assistant Examiner*—Patrick F. O'Reilly, III
(74) *Attorney, Agent, or Firm*—Catherine Ashley Straight

(57) ABSTRACT

A security module for use with a ventilation grating comprising a body, a base with a planar surface for attachment to the grating, and an outer wall extending from the base. The body has inner passageways extending from the base to the outer wall, the first portion of which extends from the base in a direction perpendicular to the base, and the second portion of which extends from the outer wall to intersect perpendicularly with the first portion within the body. The security module, when attached to a ventilation grating, prevents threading a rope-like material, through the grating, and using the makeshift rope to commit suicide by hanging, and is therefore particularly suitable for use in penal institutions, hospitals and mental health facilities.

10 Claims, 3 Drawing Sheets

SECURITY MODULE FOR USE WITH VENTILATION GRATING

BACKGROUND OF THE INVENTION

1. Field of the Invention

The invention relates generally to an apparatus designed for use in the air duct portion of a ventilation system in certain buildings, such as penal institutions, hospitals, and mental health facilities. More specifically, the invention pertains to a security module for use with a ventilation grating, having a body with a planar surfaced base and an outer wall extending from the base, the body further including inner passageways extending from said base to said outer wall, each of said passageways having a first portion extending from said base in a first axial direction perpendicular to said base, and a second portion extending from said outer wall in a second axial direction to intersect said first portion within said body, said first and second axial directions being perpendicular with respect to each other. The attachment of one or more security modules to a ventilation grating prevents the use of such grating as a means for hanging.

2. Description of the Prior Art

All buildings, and each discrete space therein, which have human inhabitants are required to have ventilation, and most have heating and air conditioning. Such heating, air conditioning and ventilation is provided through ducts into and out of the various spaces. A grille, or grating, usually covers the terminal end of the duct at the point where air enters or leaves the room or space.

Such ventilation gratings have openings in the form of slats or perforations to allow the passage of air. In penal institutions, such as jails, prisons and penitentiaries, as well as in hospitals and mental health facilities, the ventilation gratings must be constructed of a strong material and affixed to a structure, such as a ceiling or wall, to prevent removal of the grating and access to the duct. The space within the duct, immediately behind the grating, has been used by inmates or patients in such facilities to hide weapons and contraband. The ventilation grating itself has also been used by inmates or patients to hang themselves. This is accomplished by threading a rope-like material, for example dental floss, up into the duct area, securing the material over a solid portion of the grating, and bringing the material back into the cell or room. The incidence of such hangings has increased dramatically in recent years and now constitutes a very serious problem in jails, prisons and penitentiaries.

Various apparatuses have been designed for use in penal institutions, hospitals and mental health facilities. Such apparatuses are primarily directed toward grilles, registers, diffusers, and vents which have been specially adapted for use in high security applications. The majority of these grilles, registers and diffusers are designed to resist tampering or removal, and/or to prevent intrusion into the duct area; and there are only a few such apparatuses which have attempted to address the problem of an inmate or patient using the ventilation grating to commit suicide by hanging.

For example, U.S. Pat. No. 4,505,189, issued to Morris et al., discloses a plenum vacuum chamber security airflow device which is tamper-proof and resistant to vandalism. A security slot diffuser is disclosed in U.S. Pat. No. 5,205,784, issued to DeHart et al., also claims such usefulness in high security area applications. U.S. Pat. No. 5,375,373, granted to Tiede, discloses a security grille which, by use of "zig-zag" passages, impairs the ability of inmates, or other persons in a security institution, from using the grille to hang themselves. This security grille, however, still allows an inmate to feed items up into the structure and conceal them, and does not completely prevent use of the grille for hanging.

Considering the seriousness of the problem, and the fact that use of the grilles in this manner results in death, the benefits of the present invention will certainly be appreciated. The present invention completely prevents both the use of area behind the grating for concealment, and the use of the grating to commit suicide by hanging.

SUMMARY OF THE INVENTION

The security module of the present invention includes a body having a base with a planar surface which can be affixed to grating of a ventilation system, and an outer wall extending from said base. The security module further includes a plurality of inner passageways, each of said passageways having a first portion extending from the base in a first axial direction perpendicular to said base, and a second portion extending from said outer wall in a second axial direction, intersecting the first portion within the body, the first and second axial directions being perpendicular with respect to one another.

It is a principal object of the invention to provide a security backing for a grating of a ventilation system, for use in penal institutions, such as jails, prisons and penitentiaries, as well as in hospitals and mental health facilities, where there is a risk of suicide by hanging, in order to prevent such deaths using the grating in the facility. In such facilities, the grating which covers the duct of the ventilation system must be constructed of a strong material and affixed to prevent removal of the grating and access to the duct. Inmates and patients in these facilities may thread a make-shift rope, or other rope-like material, such as dental floss over the solid portions of a grating, and back into the cell or room. Once secured to the grating, the make-shift rope may be used by the inmate or patient to commit suicide by hanging.

The security module, having a plurality of passageways, the first portion extending from the base in a first axial direction perpendicular to the base, and the second portion extending from the outer wall in a second axial direction intersecting with the first portion, the first and second axial directions being perpendicular to each other, prevents an inmate or patient from threading a rope-like material, such as dental floss, up into the duct area and back into the room over a solid portion of the grating. Such threading of a rope-like material is made even more difficult if the first portion of the passageway extends slightly beyond the point where the second portion of the passageway intersects the first portion.

The construction of the passageways, as described herein, also makes it impossible for an inmate or patient to wedge another object above the ventilation grating to use to attach a make-shift rope.

A further object of the invention is to prevent intrusion into the duct area, and prevent concealment of items within the duct area. The construction of the passageways as described herein makes it very difficult to place and conceal an item, such as a weapon or contraband above the grating area. While small items may be pushed into a passageway, it will be difficult to keep such items within the passageway where they might be retrieved. By extending the first portion of the passageway beyond the point of intersection with the second portion of the passageway, it becomes much more difficult to push an item around the ninety degree (90°) "corner" at the intersection. If an item is flexible enough to be pushed into the second portion of the passageway, it will become irretrievable once it passes the outer wall of the body of the security module.

Yet another object is to solve the problem of accommodating the various shapes and sizes of ventilation gratings, such as square, rectangular, and round gratings. Security modules with a square base, and pyramidal body, are well suited for use with either square or rectangular gratings of varying sizes. Several small security modules with may be placed adjacent one another and configured to cover the surface area of the grating. A plurality of security modules with an elongated pyramidal body, placed side by side, may also be used with square or rectangular gratings. A dome shaped security module with a round planar base would be appropriate for use with a round ventilation grating. A security module with a round base could be constructed using a semi-spherical shape, facets, or a series of triangles or polygons, to form the outer wall which extends from said base.

DETAILED DESCRIPTION OF THE PREFERRED EMBODIMENT

Figure 2:
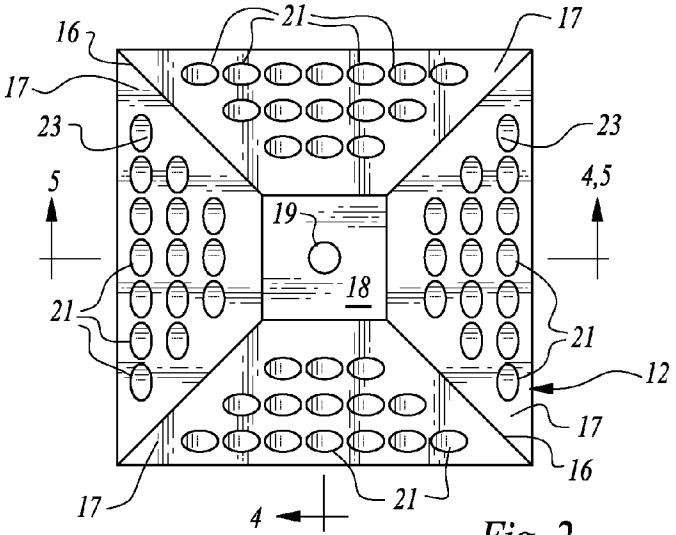
FIG. 2 is a close-up, top plan view of a security module.
Figure 3:
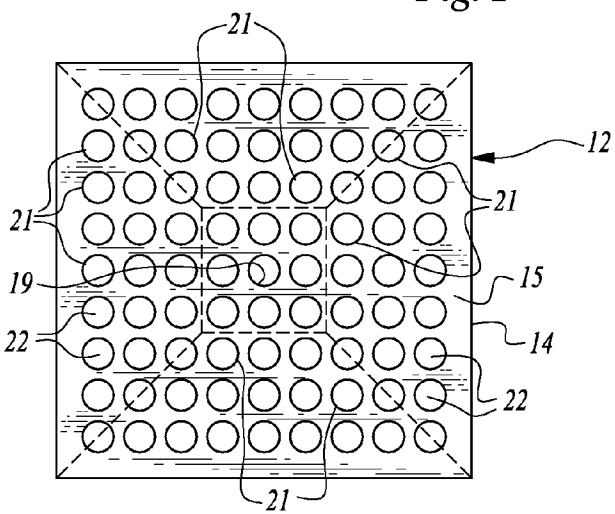
FIG. 3 is a close-up, bottom plan view of a security module.
Figure 1:
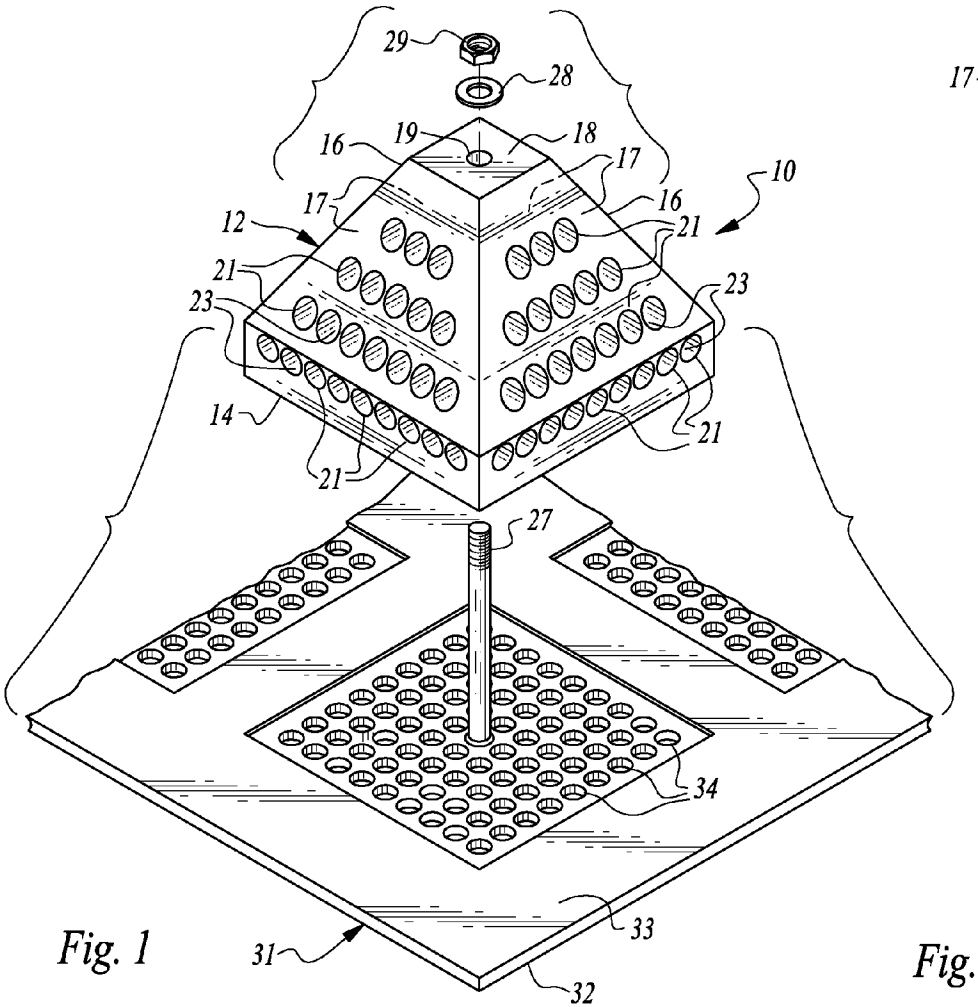
FIG. 1 is a close-up, exploded perspective view of a security module of the present invention, shown in environment, with a security module attached by means of bolt extending from a ventilation grating (shown cut away) through a bore through the center of the body of the security module and being secured with a washer and nut at the top of the security module.

Turning now to the drawings, in particular FIGS. 1, 2 and 3, a first embodiment of a security module 10 of the present invention generally comprises a body 12, having a base 14, inner passageways 21, and a means to attach the security module 10 to a ventilation grating 31.

FIG. 3 shows said base 14 having a planar surface 15 and being generally square in plan. As shown in FIGS. 1 and 2, the body 12 is generally pyramidal in configuration, having an outer wall 16 formed from four inwardly converging wall portions 17. In FIGS. 1 and 2, it can be seen that said wall portions 17, rather than converge at a peak, terminate below such point and a flattened surface of the body 12, being parallel to the planar surface 15 of said base 14, forms a top 18.

Said security module 10, as shown in all of the Figures, includes a plurality of inner passageways 21 for the passage of air. In FIG. 3, a first portion 22 of each said passageway 21 is shown extending from said planar surface 15 of said base 14. In FIGS. 1 and 2, a second portion 23 of each said passageway 21 is shown extending from one of said wall portions 17 of said outer wall 16.

Figures 4, 5, 6, 7, 8:
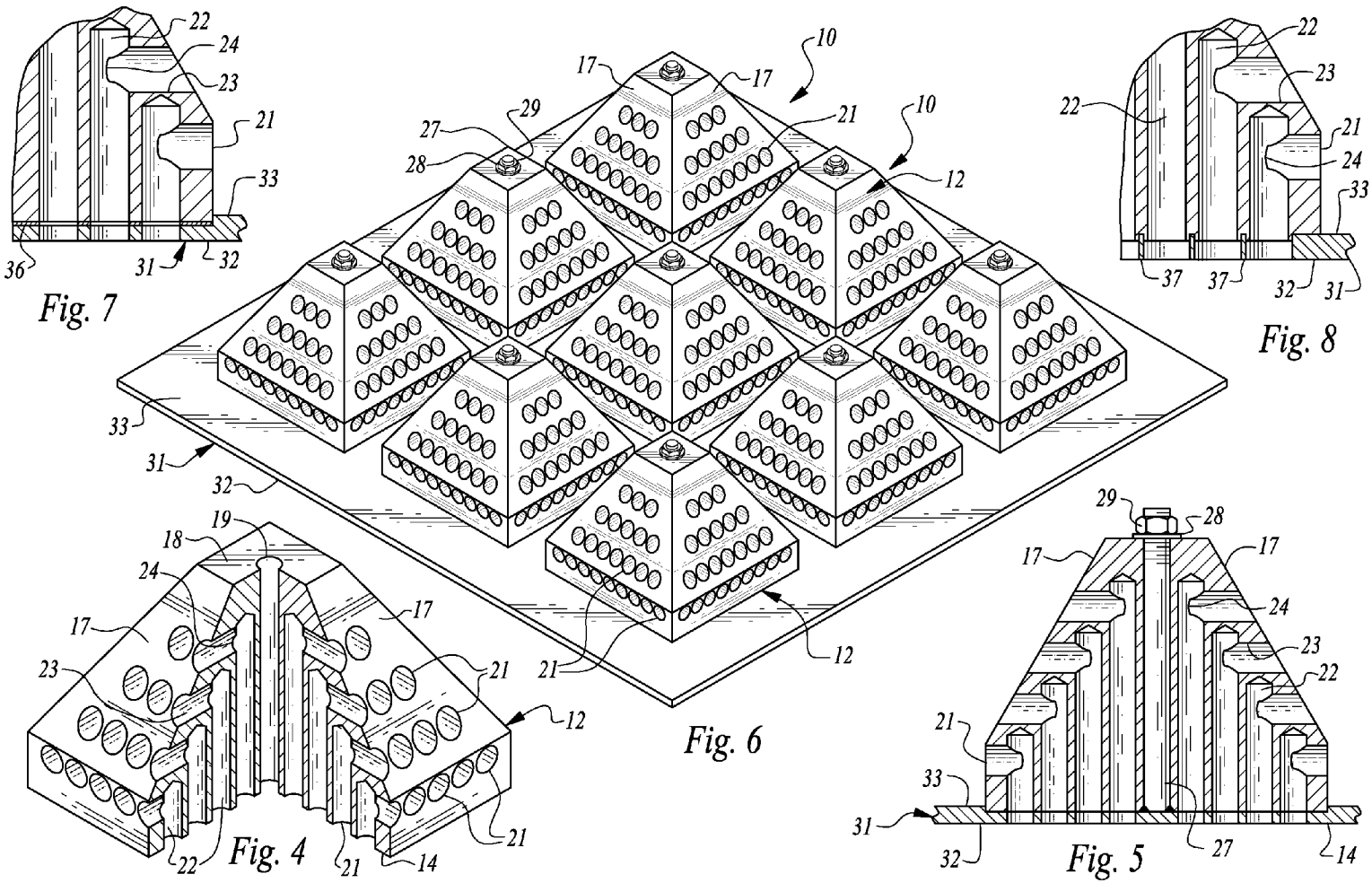
FIG. 4 is a close-up, cross-sectional view of a security module taken on the line 4-4, in FIG. 2.
FIG. 5 is a close-up, cross-sectional view of a security module taken on the line 5-5, in FIG. 2, showing inner passageways arranged in a pattern of adjacent rows, and additionally showing said security module attached to a ventilation grating (shown cut-away) by means of bolt extending vertically from the ventilation grating through a bore through the center of the body of the security module, and secured by a washer and nut at the top of the security module.
FIG. 6 is a perspective view of a plurality of security modules as in FIG. 1, with several said security modules each attached to a ventilation grating by means of a bolt, washer and nut.
FIG. 7 is a close-up, detail view of a portion of a security module as in FIG. 5, showing inner passageways extending from the base to an outer wall, and showing said security module attached to a ventilation grating (shown cut-away) by means of an adhesive.
FIG. 8 is a close-up, detail view of a portion of a security module as in FIG. 5, showing inner passageways extending from the base to an outer wall, and showing said security module attached to a ventilation grating (shown cut-away) by means of pins.

As illustrated in FIGS. 4 and 5, said first portion 22 of each passageway 21 extends from said base 14 in a first axial direction perpendicular to said base 14, and a second portion 23 of each passageway 21 extends from one of said wall portions 17 of said outer wall 16 in a second axial direction intersecting said first portion 22 within said body 12, said first and second axial directions being perpendicular with respect to one another.

FIGS. 7 and 8 show a detail view of said first portion 22 and said second portion 23 of said passageway 21, and further shows said first portion 22 extending slightly beyond the point of intersection 24 with said second portion 23. It will be appreciated that this construction makes it even more difficult to push an item which has been placed into said security module 10 around the ninety degree (90°) "corner" at said intersection 24.

In a heating, air conditioning and/or other ventilation system, an air flow duct is generally covered with a ventilation grating 31 as represented in FIG. 1. Said ventilation grating 31 includes an outer surface 32 facing a room, an inner surface 33 facing an air flow duct, and a plurality of perforations 34 through said grating 31 to pass air into, or out of, the room.

As illustrated in FIGS. 1 and 5, a security module 10 is affixed to said inner surface 33 by means of a bolt 27 extending from said outer surface 33 of said ventilation grating 31 through a bore 19 in said body 12 and secured with a washer 28 and nut 29 at the top 18. Said bore 19 through said body 12 is best seen in FIG. 4, and is also evident in FIGS. 1, 2 and 3.

It will be appreciated that said passageways 21 are constructed, and arranged in a pattern of adjacent rows in the base of said security module 10, so that said passageways 21 correspond in size, shape and placement with the perforations 34 in said ventilation grating 31, so that the flow of air through said ventilation grating 31 is unimpeded by said security module 10. FIGS. 1, 2, 4 and 5 show passageways 21 which are right-circular cylindrical in configuration to correspond with the circular perforations 34 in the ventilation grating shown in FIG. 1.

FIG. 6 shows a representative ventilation grating 31 with a plurality of security modules 10 each affixed thereto, by means of a bolt 27, washer 28, and a nut 29 as illustrated in FIG. 1. Security modules with a square plan base 14, and pyramidal body 12, as shown in FIG. 6 are well suited for use with either square or rectangular ventilation gratings 31. As evident from FIG. 6, several small security modules 10 may be placed adjacent one another and configured to cover the inner surface 33 of a ventilation grating 31. It will be understood that, by using varying numbers and arrangements of security modules 10, various shapes and sizes of ventilation grating 31, as well as varying air requirements, may be accommodated.

There exist many means to affix said security module 10 to said ventilation grating 31. Said bolt 27 may be attached to the inner surface 33 of the ventilation grating 31, as shown in FIG. 5; or may be attached to the outer surface 32 (not shown). Additional means to affix said security module 10 to said ventilation grating 31 exist, including interlocking components, a variety of clamps, brackets, straps, screws, rivets, pins and other fasteners, as well as welds and adhesives.

In FIG. 7, a partial detail view shows a security module 10 affixed to a ventilation grating 31 (shown cut-away) by means of an adhesive 36 applied at the interface between the solid portions of the security module 10 and the solid portions of the inner surface 33 of said ventilation grating 31. In FIG. 8, a partial detail view shows a security module 10 affixed to a ventilation grating 31 (shown cut-away) by means of pins 37 extending from said ventilation grating 31 into the solid portions of said security module 10.

Figure 11:
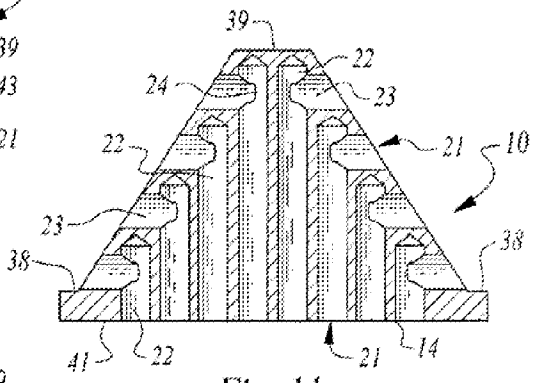
FIG. 11 is a close-up, cross-sectional view of a security module taken on the line 11-11, in FIG. 9.
Figure 9:
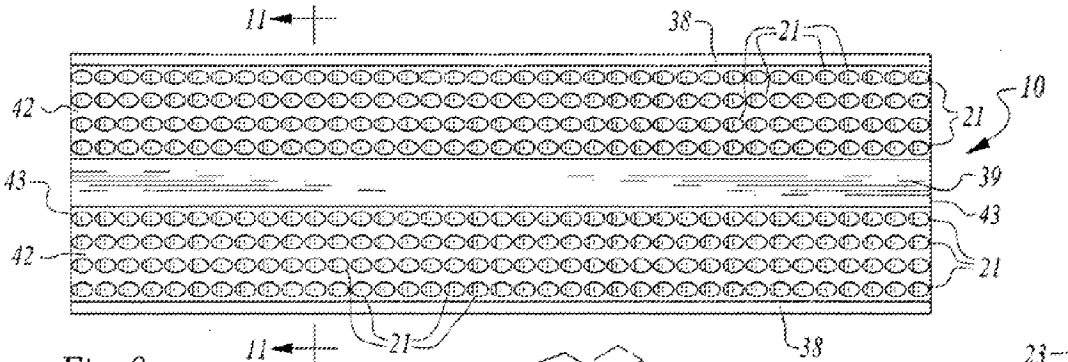
FIG. 9 is a close-up, top plan view of an alternate embodiment of a security module, said security module having an elongated body.
Figure 10:
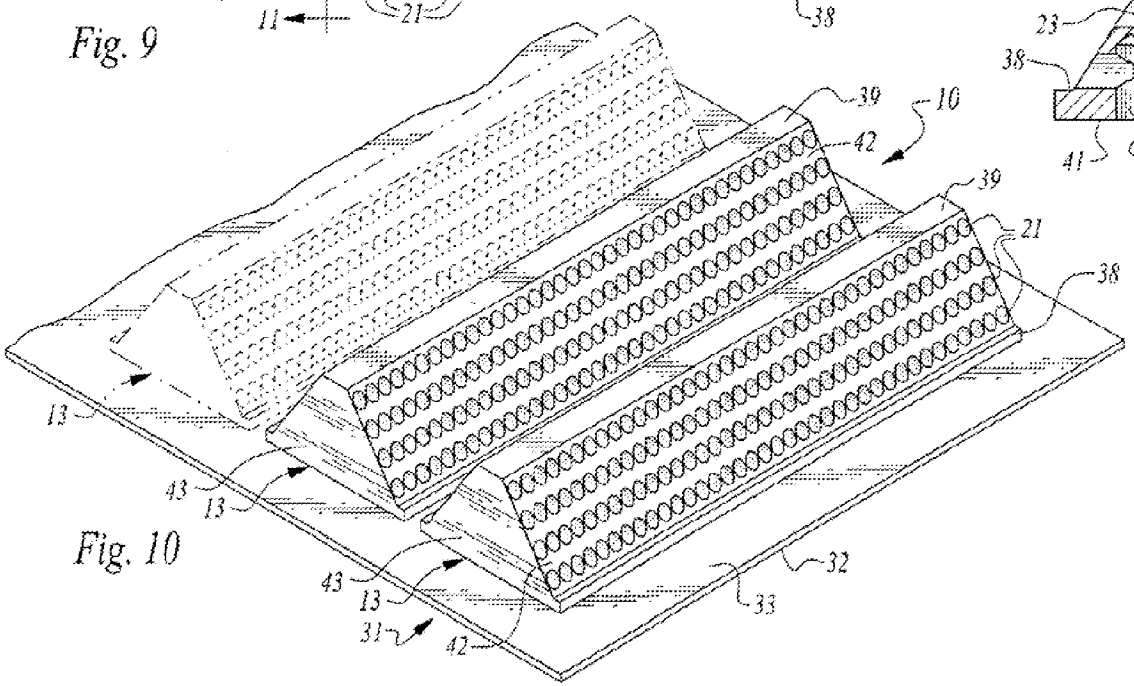
FIG. 10 is a perspective view of a plurality of security modules as in FIG. 9, with several said security modules each attached to a ventilation grating (shown cut-away)

In FIGS. 9, 10 and 11, a second embodiment of a security module 10 is shown. In this second embodiment, said security module 10 comprises a body 13, having a base 41, inner passageways 21, and a means to attach the security module 10 to a ventilation grating 31. Said body 13 has a planar base 41 (shown in FIG. 11). As seen in FIGS. 9 and 10, said body 13 is rectangular in plan, having an outer wall 44. Said body 13 is elongated, having opposing elongated sides 42 and opposing transverse ends 43 which form said outer wall 44.

The partially pyramidal configuration of said body 13 is best seen in FIG. 10, which shows said outer wall 44 being formed by said opposing elongated sides 42 converging inwardly to said opposing transverse ends 43. As can be seen in FIGS. 10 and 11, said opposing elongated sides 42, rather than converge at a vertex, terminate below such point and a flattened surface of the body 13, being parallel to said base 41, form a top 39.

As illustrated in FIG. 11, said first portion 22 of said passageway 21 extends from said base 41 in a first axial direction perpendicular to said base 41, and a second portion 23 of said passageway 21 extends from one of said opposing elongated sides 42 in a second axial direction intersecting said first portion 22 within said body 13, said first and second axial directions being perpendicular with respect to one another. As is apparent from FIG. 10, said second portion 23 of said passageway 21 extends only from one or the other of said opposing elongated sides 42, and not from either opposing transverse ends 43.

In this embodiment, as shown in FIGS. 9, 10 and 11, each of the inwardly converging elongated sides 42 have a lower edge extending therefrom in a direction parallel to said base 41 to form a flange 38. It will be appreciated that inclusion of said flange 38 results in additional space between multiple security modules 10 to enhance air flow, as well as provide additional area for affixing said security module 10 to a ventilation grating 31 by any of various means previously discussed.

In FIG. 10, a representative ventilation grating 31 (shown cut-away) with a plurality of security modules 10 affixed thereto is shown. As is evident from this FIG. 10, several security modules 10 with may be placed adjacent one another to cover the inner surface 33 of said ventilation grating 31. It will be understood that the length of the elongated sides 42 and the width at the base 41 of the transverse ends 43 may be varied to accommodate various shapes and sizes of a ventilation grating 31, as well as varying air requirements.

As illustrated in FIG. 11, said passageways 21 are formed utilizing a first portion 22 and a second portion 23, in axial directions perpendicular with respect to one another; it therefore becomes nearly impossible for an inmate or patient to thread or pass a rope-like material, such as dental floss, from said outer surface 32 of said ventilation grating 31 up into said passageway 21 and back through a different passageway 21 into the room. As further illustrated in FIG. 11, such threading of a rope-like material is made even more difficult by extending said first portion 22 of said passageway 21 slightly beyond the point of intersection 24 with said second portion 23.

Although not illustrated in the drawings, it will be understood that a security module may be constructed with a round planar base, which would be appropriate for use with a round ventilation grating. A body of said security module with a round base could be constructed using a semi-spherical shape, a plurality of facets, or a series of triangles or polygons, to form an outer wall which extends from said round base. As with the other configurations of said security module, the passageways 21 are formed from a first portion 22 of said passageway 21 which extends from said round base in a first axial direction perpendicular to said round base, and a second portion 23 of said passageway 21 which extends from one of said outer wall in a second axial direction intersecting said first portion 22 within the body of said security module, said first and second axial directions being perpendicular with respect to one another.

A security module, in any of the configurations as described herein, may be constructed from any of several materials. These materials include a variety of plastics, as well as aluminum and other metals.

It will be appreciated, then, that I have disclosed herein a security module which prevents threading a rope-like material, through a ventilation grating, and using the make-shift rope to commit suicide by hanging, which security module is particularly suitable for use in penal institutions, such as jails, prisons and penitentiaries, as well as in hospitals and mental health facilities.

What is claimed is:

1. A security ventilation grating comprising:

a. a perforated ventilation grating having an outer surface facing a room and an inner surface facing a ventilation duct;

b. a body, said body having a base with a planar surface covering said inner surface of said ventilation grating and an outer wall extending into said ventilation duct from said base, said body further including a plurality of inner passageways extending from said base to said outer wall, each of said passageways having a first portion extending from said base in a first axial direction perpendicular to said base, and a second portion extending from said outer wall in a second axial direction to intersect said first portion within said body, said first and second axial directions being perpendicular with respect to each other; and, c. means to affix said body over said inner surface of said ventilation grating.

2. A security ventilation grating as in claim 1 in which said body is generally pyramidal in configuration, and in which said base is generally square in plan and said outer wall is formed from four inwardly converging wall portions.

3. A security ventilation grating as in claim 1 in which said body is elongated, and in which said base is rectangular in plan having opposing elongated sides and opposing transverse ends.

4. A security ventilation grating as in claim 3 in which said outer wall includes two inwardly converging wall portions each having a lower edge extending from a respective one of said elongated sides.

5. A security ventilation grating as in claim 1 in which said means to affix comprises a bolt extending from said outer surface of said ventilation grating through said body.

6. A security ventilation grating as in claim 1 in which said means to affix comprises a weld between said base and said inner surface of said ventilation grating.

7. A security ventilation grating as in claim 1 in which said means to affix comprises a restraint strap over an outer edge of said outer wall.

8. A security ventilation grating as in claim 1 in which said means to affix comprises an adhesive between said base and said inner surface of said ventilation grating.

9. A security ventilation grating as in claim 1 in which each said first portion of said passageways is constructed and arranged in a pattern corresponding in size, shape and placement with the perforations of the ventilation grating.

10. A security ventilation grating as in claim 1 comprising a plurality of contiguous modules in which said first portion of said passageways of each said module is constructed and arranged in a pattern corresponding in size, shape and placement with the perforations of the ventilation grating.

* * * * *